US011414299B2

(12) United States Patent
Kattainen et al.

(10) Patent No.: US 11,414,299 B2
(45) Date of Patent: Aug. 16, 2022

(54) ARRANGEMENT IN AN ELEVATOR FOR STOPPING UNCONTROLLED MOVEMENT OF THE ELEVATOR CAR

(71) Applicant: Kone Corporation, Helsinki (FI)

(72) Inventors: Ari Kattainen, Helsinki (FI); Matti Rasanen, Helsinki (FI); Markku Haapaniemi, Helsinki (FI)

(73) Assignee: Kone Corporation, Helsinki (FI)

( * ) Notice: Subject to any disclaimer, the term of this patent is extended or adjusted under 35 U.S.C. 154(b) by 301 days.

(21) Appl. No.: 16/670,307

(22) Filed: Oct. 31, 2019

(65) Prior Publication Data

US 2020/0062546 A1 Feb. 27, 2020

Related U.S. Application Data

(63) Continuation of application No. PCT/FI2017/050386, filed on May 23, 2017.

(51) Int. Cl.

| | |
|---|---|
| ***B66B 5/24*** | (2006.01) |
| ***B66B 5/04*** | (2006.01) |
| ***B66B 5/12*** | (2006.01) |

(52) U.S. Cl.

CPC ..... *B66B 5/24* (2013.01); *B66B 5/04* (2013.01); *B66B 5/12* (2013.01)

(58) Field of Classification Search

CPC .. B66B 5/24; B66B 5/04; B66B 5/042; B66B 5/044; B66B 5/12

See application file for complete search history.

(56) References Cited

U.S. PATENT DOCUMENTS

| | | | | |
|---|---|---|---|---|
| 10,099,904 | B1 * | 10/2018 | Zaguroli, Jr. | B66D 1/54 |
| 10,654,685 | B2 * | 5/2020 | Fauconnet | B66B 5/16 |
| 2009/0229923 | A1 * | 9/2009 | Aulanko | B66B 11/007 187/266 |
| 2009/0288920 | A1 * | 11/2009 | Kattainen | B66B 1/32 187/287 |
| 2011/0278099 | A1 * | 11/2011 | Kattainen | B66B 1/32 187/288 |
| 2014/0034425 | A1 * | 2/2014 | Rasanen | B66B 11/0045 187/256 |

(Continued)

FOREIGN PATENT DOCUMENTS

| | | | | |
|---|---|---|---|---|
| FR | 2624840 | A1 * | 6/1989 | B66B 5/24 |
| KR | 20070046286 | A | 5/2007 | |
| WO | WO-2009078844 | A1 * | 6/2009 | B66B 5/24 |

OTHER PUBLICATIONS

International Search Report PCT/ISA/210 for International Application No. PCT/FI2017/050386 dated Dec. 5, 2017.

(Continued)

*Primary Examiner* — Michael A Riegelman
(74) *Attorney, Agent, or Firm* — Harness, Dickey & Pierce, P.L.C.

(57) ABSTRACT

Arrangement in an elevator for stopping uncontrolled movement of an elevator car, which elevator comprises at least an elevator car (1) arranged to move reciprocally in the elevator hoistway along guide rails (1*a*), and means for stopping uncontrolled movement of the elevator car (1). The arrangement according to the invention comprises an arrester (4, 5) separate from the guide rails (1*a*) of the elevator car (1) and independent of the suspension of the elevator car (1).

16 Claims, 3 Drawing Sheets

(56) References Cited

U.S. PATENT DOCUMENTS

Figure 1:
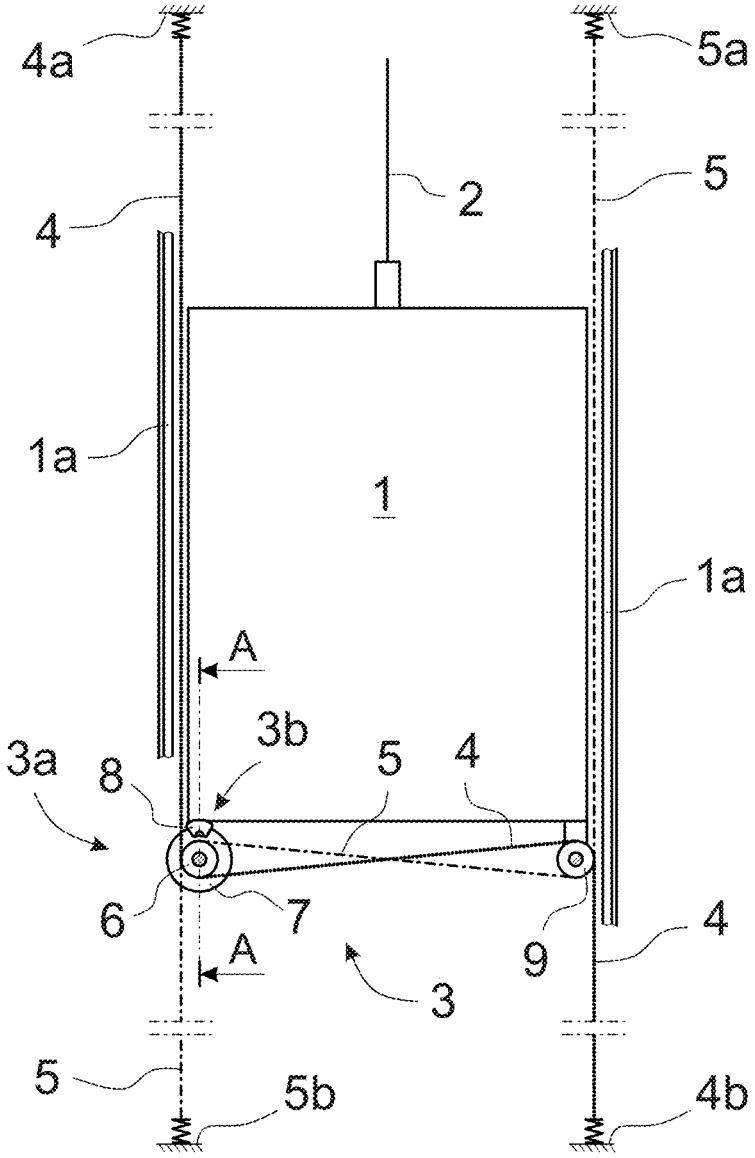

| | | | | |
|---|---|---|---|---|
| 2014/0083802 | A1* | 3/2014 | Aulanko | B66B 7/10 187/265 |
| 2014/0332326 | A1* | 11/2014 | Mikkonen | B66B 11/0045 187/414 |
| 2020/0062546 | A1* | 2/2020 | Kattainen | B66B 5/16 |

OTHER PUBLICATIONS

Written Opinion of the International Searching Authority PCT/ISA/237 for International Application No. PCT/FI2017/050386 dated Dec. 5, 2017.

* cited by examiner

ARRANGEMENT IN AN ELEVATOR FOR STOPPING UNCONTROLLED MOVEMENT OF THE ELEVATOR CAR

This application is a continuation of PCT International Application No. PCT/FI2017/050386 which has an International filing date of May 23, 2017, the entire contents of which are incorporated herein by reference.

The object of the invention is an arrangement, as defined in the preamble of claim 1, in an elevator for stopping uncontrolled movement of the elevator car.

According to the EU Lifts Directive, an elevator must have means for stopping uncontrolled movement of an elevator car in both directions. These types of means must be able to prevent free fall of an elevator car and uncontrolled upward movement of an elevator car if the operating power is disconnected or if components of the elevator fail. The means stopping an elevator car may not, in such a case, in any loading situations whatsoever cause such a deceleration of velocity that would cause harm to the elevator passengers.

Typically, these types of means stopping an elevator car in an abnormal situation comprise one or more safety gear devices on the elevator car, and an overspeed governor connected to the safety gear device(s), the overspeed governor being arranged to activate the safety gear device e.g. by means of a thin rope. If the speed of movement of the elevator car, and simultaneously the speed of rotation of the overspeed governor connected to the elevator car with a rope, rises to become too high, the centrifugal apparatus of the overspeed governor stops the rotational movement of the overspeed governor, in which case the aforementioned rope of the overspeed governor transmits force to the gripping means of the safety gear device on the elevator car, the wedges of which gripping means press in the wedge housing against the car guide rails and stop movement of the elevator car.

One problem in safety gear solutions known in the art is that gripping often takes place slightly unevenly, in which case a greater deceleration force is exerted on one car guide rail than on the other. For this reason, the elevator car, or in those solutions in which a car sling around the elevator car is used, the car sling must be made so strong that it withstands the forces produced by uneven gripping. This increases the weight of the structures and raises costs.

Another problem is that the car guide rails must be dimensioned to withstand also the forces exerted by gripping, because the gripping takes place on the car guide rails. In this case the guide rails must generally be considerably stronger than guide rails that would need to withstand only the forces produced by guiding the movement of the elevator car.

Yet another drawback in safety gear solutions known in the art is that the gripping in them leaves traces on the guide surfaces of the guide rails, which traces must be removed, e.g. by filing, before the elevator can be taken into use again. Otherwise the aforementioned gripping traces would too quickly wear the guide shoes of an elevator traveling along the guide rails. Removal of gripping traces is extra work, which delays taking the elevator into service and incurs extra costs.

The aim of the present invention is to eliminate the aforementioned drawbacks and achieve an inexpensive and easy-to-implement arrangement in an elevator for stopping uncontrolled movement of the elevator car. The arrangement according to the invention is characterized by what is disclosed in the characterization part of claim 1. Other embodiments of the invention are characterized by what is disclosed in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise, the different details presented in connection with each embodiment can also be applied in other embodiments. In addition, it can be stated that at least some of the subordinate claims can, in at least some situations, be deemed to be inventive in their own right.

The arrangement according to the invention relates to stopping uncontrolled movement of an elevator car in an elevator, which elevator comprises at least an elevator car arranged to move reciprocally in the elevator hoistway along guide rails, and means for stopping uncontrolled movement of the elevator car. One preferred arrangement according to the invention is characterized in that the arrangement comprises an arrester separate from the guide rails of the elevator car and independent of the suspension of the elevator car, and in that the means for stopping uncontrolled movement of the elevator car comprise a stopper means rotating around its axis of rotation from the effect of the movement of the elevator car, the rotational movement of which stopper means is arranged to be stoppable after the speed of movement of the elevator car has increased to be higher than a predefined speed. The arrangement according to one preferred embodiment of the invention is characterized in that the stopper means is mounted rotatably on bearings on the elevator car and connected at its outer rim to the arrester in such a way that when the elevator car moves, the stopper means follows the arrester and receives its rotational movement from the arrester.

One advantage, among others, of the solution according to the invention is that stopping unintended and uncontrolled movement of an elevator car does not take place by gripping the car guide rails, in which case elevator car guide rails that are lightweight and inexpensive in cost can be used. In this case the guide rails of the elevator car can be fabricated e.g. from cold-formed steel plate, in which case the guide rails can be e.g. approx. three times lighter than in solutions according to prior art. This facilitates handling of the guide rails in conjunction with, inter alia, transportation and installation.

In addition, one advantage is that the elevator car and/or the car sling do not need to be dimensioned to withstand one-sided gripping. Another advantage also is that, when supported by gripping, the suspension of the elevator car is balanced. Thus, lighter elevator cars can be made. Another advantage is also a controlled stop of the uncontrolled movement of the elevator car, the stop being independent of the suspension of the elevator car. Yet another advantage is that removal of gripping traces no longer causes delays and extra work while waiting for the elevator to be put back into service after gripping has occurred.

Figure 2:
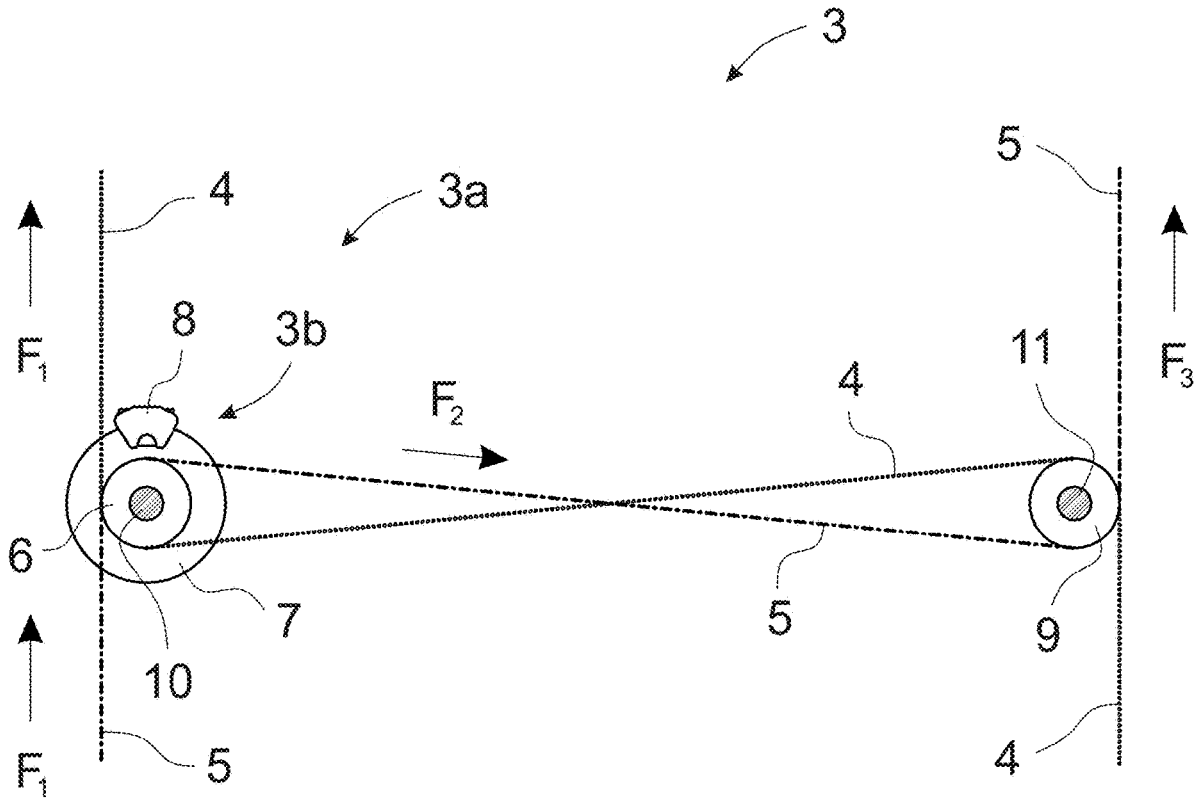
Figure 3:
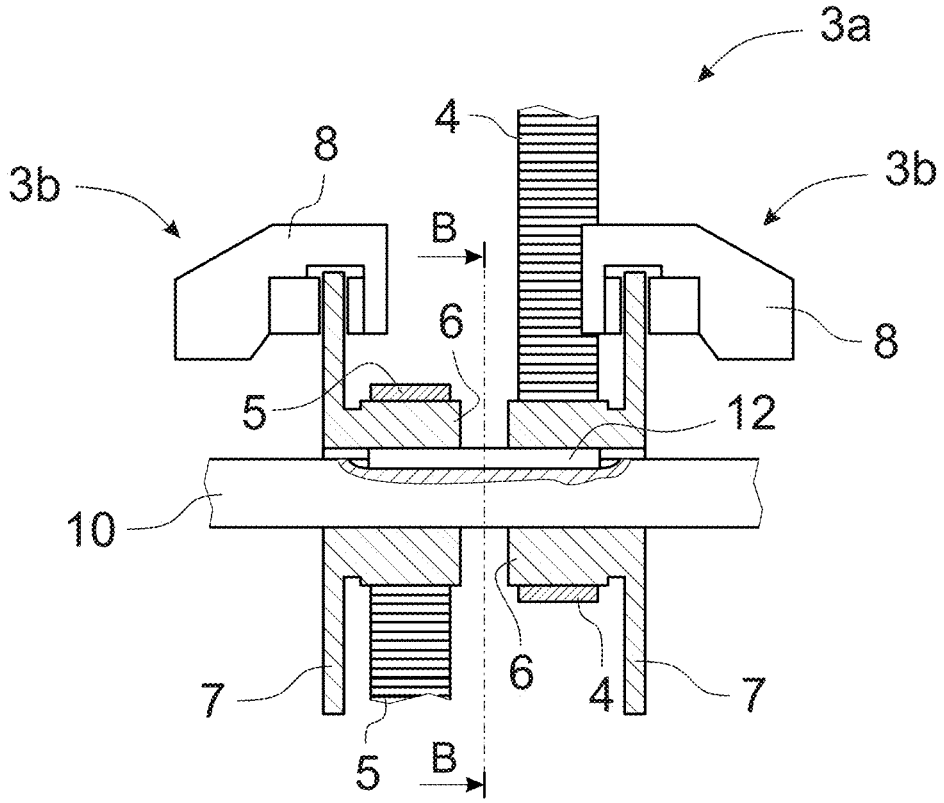
Figure 4:
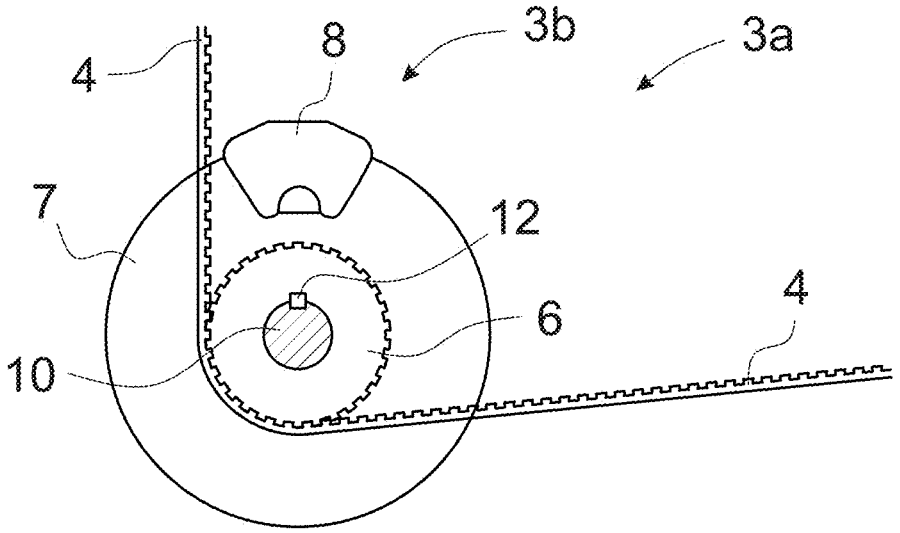

In the following, the invention will be described in more detail by the aid of an example of its embodiment with reference to the simplified and diagrammatic drawings attached, wherein FIG. 1 presents a diagrammatic and simplified side view of a part of one elevator provided with an arrangement according to the invention for preventing uncontrolled movement, FIG. 2 presents a diagrammatic, simplified, magnified and sectioned side view of the structure of the arrangement according to FIG. 1 for preventing uncontrolled movement, the arrangement being on the bottom part of the elevator car, FIG. 3 presents a simplified and magnified view of a safety gear means according to the invention, sectioned along the sectioning line A-A of FIG. 1, and FIG. 4 presents a simplified and magnified view of one half of a safety gear means according to the invention, sectioned along the sectioning line B-B of FIG. 3.

FIG. 1 presents a diagrammatic and simplified side view of an elevator car 1 in one elevator according to the invention, the elevator being provided with a new prevention arrangement 3 for uncontrolled movement, instead of a safety gear solution according to prior art, the new prevention arrangement 3 being arranged to stop uncontrolled movement of the elevator car 1. In the solution according to the embodiment the elevator car 1 traveling on its guide rails 1*a* is suspended from the suspension ropes 2, which suspension ropes 2 can also function as the moving means of the elevator car 1. For the sake of clarity only a part of the guide rails 1*a* of the elevator car 1 are presented in FIG. 1, and the other normal components of the elevator are not presented at all.

In addition to the elevator car 1, FIG. 1 also presents a prevention arrangement 3 for uncontrolled movement of the elevator car 1, the arrangement comprising a safety gear means 3*a* provided with a stopper means 6 rotating round its center axis and with a brake, a freely rotating diverting means 9 as well as at least two flexible, essentially immobile, arresters 4 and 5, which function as movement transmission means. The arresters 4 and 5 are arranged to travel below the elevator car 1 crosswise to each other and thus to support the elevator car as evenly as possible.

The stopper means 6 is arranged to be in contact with an essentially immobile arrester 4, 5 and to receive through this contact its rotational movement from the arrester 4, 5 when the elevator car 1 moves and simultaneously carries the stopper means 6.

In a gripping situation, the rotational movement of the stopper means 6 is stopped in a controlled manner by means of the brake. Preferably the stopping is implemented at a deceleration that does not cause harm to passengers in the elevator car 1. The arrangement 3 according to the invention for preventing uncontrolled movement of an elevator car 1 is separate from and independent of the supports of the elevator car 1 and does not rest on the guide rails 1*a* of the elevator car 1.

In a solution according to one preferred embodiment of the invention the flexible arresters 4 and 5 are toothed belts, the rotating stopper means 6 are cogged belt pulleys, and the rotating diverting means 9 are diverting pulleys with smooth surfaces. Hereinafter in this description when referring to the aforementioned means, the terms according to a preferred embodiment of them will be used.

Both the crisscross toothed belts 4, 5 of the arrangement 3 for stopping uncontrolled movement of an elevator car 1 are arranged to travel over a cogged belt pulley 6 and a diverting pulley 9 when the elevator car 1 moves upwards and downwards on its guide rails 1*a*. The cogged belt pulley 6 is arranged to function in a gripping situation as a means stopping uncontrolled movement of the elevator car 1, which means stops the elevator car 1 on the toothed belts 4, 5 functioning as arresters.

The first toothed belt 4 is fixed at its first end via a flexible fixing means to its first fixing point 4*a*, e.g. to the roof of the elevator hoistway or to the top part of the elevator hoistway, from which fixing point 4*a* the toothed belt 4 is led downwards and to pass under the first cogged belt pulley 6 of the safety gear means 3*a* on the bottom part of the elevator car 1, after which the first toothed belt 4 is led over the first diverting pulley 9 on the bottom part of the elevator car 1, e.g. on the corner of the elevator car 1 opposite the first cogged belt pulley 6, and after passing around the first diverting pulley 9 to continue its journey downwards to its fixing point 4*b* of the second end in the bottom part of the elevator hoistway, e.g. to the floor of the elevator hoistway, to which the first toothed belt 4 is fixed at its second end via a flexible fixing means. In this way, the toothed belt 4 is at the point of the elevator car 1 and above it on the first side of the elevator car 1, and below the elevator car 1 on the second side of the elevator car 1.

Correspondingly, the second toothed belt 5 is fixed at its second end via a flexible fixing means to its second fixing point 5*b* in the bottom part of the elevator hoistway, e.g. to the floor of the elevator hoistway, from which fixing point 5*b* the second toothed belt 5 is led upwards and to pass over the second cogged belt pulley 6 of the safety gear means 3*a* on the bottom part of the elevator car 1, after which the second toothed belt 5 is led under the second diverting pulley 9 on the bottom part of the elevator car 1, e.g. on the corner of the elevator car 1 opposite the second cogged belt pulley 6, and after passing around the bottom of the diverting pulley 9 to continue its journey upwards to its fixing point 5*a* of the first end in the top part of the elevator hoistway, e.g. on the roof of the elevator hoistway, to which the second toothed belt 5 is fixed at its first end via a flexible fixing means. In this way, the toothed belt 5 is at the point of the elevator car 1 and above it on the second side of the elevator car 1, and below the elevator car 1 on the first side of the elevator car 1.

FIG. 2 presents a diagrammatic, simplified, magnified and sectioned side view of the structure of the arrangement 3 according to FIG. 1 for preventing uncontrolled movement of the elevator car 1, the arrangement being on the bottom part of the elevator car 1. The prevention arrangement 3 in FIG. 2 is sectioned in such a way that in the safety gear means 3*a* only the brake disc 7 and brake caliper 8 of the brake 3*b* of the first toothed belt 4 is shown as well as the cogged belt pulley 6 of the second toothed belt 5, behind which cogged belt pulley is the cogged belt pulley 6 of the first toothed belt 4. The brake discs 7 and cogged belt pulleys 6 of both toothed belts 4, 5 are on a common shaft 10 and rotate at the same speed and in the same direction along with the shaft 10, which shaft 10 is mounted on bearings e.g. on the frame of the brake 3*b* or on some other suitable place on the bottom part of the elevator car 1, e.g. on the bottom corner of the elevator car 1.

On the bottom part of the elevator car 1, e.g. on the bottom corner of the elevator car 1 opposite the safety gear means 3*a*, is a diverting pulley assembly comprising either one common smooth-surfaced diverting pulley 9 for both toothed belts 4 and 5 or one smooth-surfaced diverting pulley 9 for each toothed belt. The diverting pulley or diverting pulleys 9 are preferably fixed to one axis of rotation 11, which is mounted on bearings in a suitable location on the bottom part of the elevator car 1.

FIG. 2 also presents the distribution of gripping forces F in the toothed belts 4 and 5 on different sides of the elevator car 1. Since gripping occurs with one safety gear means 3*a*, the same gripping force acts on the cogged belt pulley 6 of both toothed belts 4 and 5, so that also exactly the same gripping force $F=F_1=F_2=F_3$ acts on both toothed belts 4 and 5. In this case, therefore, $F_1=F_3$, so no one-sided gripping can occur.

FIGS. 3 and 4 present a simplified, magnified and appropriately sectioned safety gear means 3*a* according to the invention. FIG. 3 presents a safety gear means 3*a* according to the invention sectioned along the sectioning line A-A of FIG. 1, however in such a way that for the sake of clarity the brake calipers 8 are not sectioned. Correspondingly, FIG. 4 presents one half of a safety gear means 3*a* according to the invention sectioned along the sectioning line B-B of FIG. 3.

In the embodiments of FIGS. 3 and 4, each toothed belt 4 and 5 has its own cogged belt pulley 6 and its own brake 3*b* with brake disc 7 and brake caliper 8. The cogged belt pulleys 6 and brake discs 7 are fixed by means of a key 12 to rotate along with their common axis of rotation 10 rotated by the toothed belts 4 and 5 when the elevator car 1 moves. It is essential that both cogged belt pulleys 6 always rotate at the same speed and that an equal gripping force is always exerted on them. The brake calipers 8 provided with brake pads are fixed non-rotatably to the frame of the brake 3*b* or to some other suitable location.

Instead of the separate cogged belt pulleys 6 and brakes 3*b* presented above, the toothed belts 4 and 5 can advantageously have only one common cogged belt pulley 6, and also only one common brake 3*b* with brake disc 7 and brake caliper 8.

The arrangement according to the invention also comprises an overspeed governor for movement of the elevator car 1, which overspeed governor for the sake of clarity is not, however, presented. Preferably, the operation of the overspeed governor is based on centrifugal force. The overspeed governor can be a conventional overspeed governor used in elevators.

In one preferred solution according to the invention, the overspeed governor is connected directly to the brake 3*b* of the safety gear means 3*a* and to the rotating parts of the safety gear means 3*a*, e.g. either to the brake discs 7, to the cogged belt pulleys 6 or to their common axis of rotation 10. In such a case, a separate rope for the overspeed governor is not needed in centrifugal triggering for stopping uncontrolled movement of the elevator car. The overspeed governor is connected to the rotating parts of the safety gear means 3*a* moving along with the elevator car 1 to rotate in such a way that the centrifugal weights rotate at the same speed as the axis of rotation 10. If the speed of the elevator car 1 increases to become higher than a predefined limit speed, the speed of rotation of the shaft 10 also increases to such that the centrifugal weights cause so-called centrifugal triggering, which activates the brake 3*b* of the safety gear means 3*a*. In such a case, uncontrolled movement of the elevator car 1 stops in a controlled manner as a result of the brake 3*b*.

One way to activate the brake 3*b* of the safety gear means 3*a* when centrifugal triggering has occurred is such that the cogged belt pulleys 6 rotating the safety gear means 3*a* are arranged to produce pressure or force that is transmitted to the brake 3*b* of the safety gear means 3*a*, whereby the brake pads of the brake caliper 8 press against the brake discs 7 of the brake 3*b*. The speed of the centrifugal triggering can preferably be adjusted e.g. electrically.

Alternatively, the brake pads of the brake caliper 8 can be pressed against the brake discs 7 by means of springs. In such a case, the brakes must be opened by means of an electromagnet, fluid pressure or air pressure, so the arrangement must have a power supply or pressure accumulator for producing opening energy during rescue operations.

What is essential in the solution according to the invention is that arrester is separate from the guide rails 1*a* of the elevator car 1, in which case gripping, i.e. stopping uncontrolled movement of the elevator car 1, does not stress the guide rails 1*a* of the elevator car 1. The arrester is preferably e.g. the aforementioned toothed belt arrangement, in which two toothed belts 4 and 5 are disposed crisscrossing each other to travel from below the trajectory of the elevator car 1 to above the trajectory and to rotate a cogged belt pulley 6 fitted to move along with the elevator car 1 when the elevator car 1 moves, the cogged belt pulley being in tooth contact with a toothed belt 4, 5. Rotation of the cogged belt pulley 6 is stopped in a gripping situation on the basis of triggering of the overspeed governor traveling along with the elevator car 1. Controlled stopping of the cogged belt pulley 6 is implemented by means of a brake 3*b*, e.g. a disc brake.

It is obvious to the person skilled in the art that the invention is not limited solely to the examples described above, but that it may be varied within the scope of the claims presented below. Thus, for example, the arrangement according to the invention can be different to what is presented above.

It is also obvious to the person skilled in the art that the arrester of the elevator car can be some other suitable structure, e.g. a flexible chain, such as a transmission chain, suited to the purpose, instead of a toothed belt. In such a case, instead of cogged belt pulleys, the stopper means and diverting means will be e.g. a sprocket wheel.

It is also obvious to the person skilled in the art that instead of a toothed belt the arrester of the elevator car can be a steel wire rope or some other belt than a toothed belt, e.g. a V-belt, in which case the stopper means is adapted to be suitable for his belt.

A person skilled in the art will understand that instead of a round stopper means the invention can use also some other type of stopper means, e.g. a gripper, e.g. a rope gripper, compressively gripping the arrester.

The invention claimed is:

1. An arrangement in an elevator for stopping uncontrolled movement of an elevator car, the arrangement comprising:

a stopping device configured to stop the uncontrolled movement of the elevator car, the stopping device including a first pulley attached to a bottom of the elevator car towards a first side of the elevator car, the first pulley having a brake associated therewith;

a second pulley attached to the bottom of the elevator car towards a second side of the elevator car opposite the first side; and an arrester separate from guide rails of the elevator car and independent of a suspension of the elevator car, the arrester configured to travel across the bottom of the elevator car from the first pulley to the second pulley.

2. The arrangement according to claim 1, wherein stopping device is configured to perform a rotational movement about axis of rotation in response to movement of the elevator car, and to perform a controlled stoppage of the rotational movement about the axis of rotation after a speed of movement of the elevator car exceeds a predefined speed.

3. The arrangement according to claim 2, wherein the stopping device is mounted rotatably on bearings on the elevator car with an outer rim of the stopping device connected to the arrester in such a way that, when the elevator car moves, the stopping device follows the arrester.

4. The arrangement according to claim 2, wherein the arrangement further comprises:

a brake configured to stop the rotational movement of the stopping device.

5. The arrangement according to claim 1, wherein the arrester is flexible.

6. The arrangement according to claim 1, wherein the arrester includes at least two arresters disposed symmetrically with respect to the elevator car with a first end of each of the at least two arresters fixed above the elevator car and a second end of each of the at least two arresters fixed below the elevator car.

7. The arrangement according to claim 6, wherein the at least two arresters includes a first arrester and a second arrester, the first end of the first arrester is fixed to a top part of an elevator hoistway and the second end of the first arrester is fixed to a bottom part of the elevator hoistway in such a way that the first arrester is fixed above the elevator car on the first side of the elevator car and fixed below the elevator car on the second side of the elevator car, and the first end of the second arrester is fixed to the top part of the elevator hoistway and the second end of the second arrester is fixed to the bottom part of the elevator hoistway in such a way that the second arrester is fixed above the elevator car on the second side of the elevator car and fixed below the elevator car on the first side of the elevator car.

8. The arrangement according to claim 1, wherein the arrester is a chain and the first pulley is a sprocket wheel.

9. The arrangement according to claim 1, wherein the arrester is a belt, and the first pulley includes a belt wheel.

10. The arrangement according to claim 9, wherein the arrester is a toothed belt and the first pulley is a cogged belt pulley.

11. The arrangement according to claim 9, wherein the arrester is a V-belt.

12. The arrangement according to claim 1, wherein the arrester is a steel wire rope and the first pulley includes a rope pulley.

13. The arrangement according to claim 1, wherein an overspeed governor is configured to rotate along with the stopping device.

14. The arrangement according to claim 1, wherein the arrester is configured to travel from a first fixing point at a top of an elevator hoistway, across the bottom of the elevator car from the first pulley to the second pulley and down to a second fixing point at a bottom of the elevator hoistway.

15. The arrangement according to claim 1, wherein the arrester includes a pair of arresters each configured to travel from a respective one of a plurality of first fixing points at a top of an elevator hoistway, across the bottom of the elevator car from the first pulley to the second pulley and from the second pulley to the first pulley, respectively, and down to a respective one of a plurality of second fixing point at the bottom of the elevator hoistway.

16. The arrangement according to claim 1, wherein the pair of arresters travel across the bottom of the elevator car from the first pulley to the second pulley and from the second pulley to the first pulley, respectively, such that a same gripping force is exerted on each of the pair of arresters.

* * * * *